US005529057A

United States Patent [19]

Ferrero et al.

[11] Patent Number: 5,529,057

[45] Date of Patent: Jun. 25, 1996

[54] SNORKEL SPLASH PROTECTOR

[75] Inventors: Jaime Ferrero; Timothy N. Curameng, both of Chicago, Ill.

[73] Assignee: Dacor Corporation, Northfield, Ill.

[21] Appl. No.: 473,087

[22] Filed: Jun. 7, 1995

[51] Int. Cl.[6] ..... B63C 11/16

[52] U.S. Cl. ..... 128/201.11; 128/200.24

[58] Field of Search ..... 128/201.11, 207.17, 128/201.26, 201.27, 201.28, 200.29, 200.24

[56] References Cited

U.S. PATENT DOCUMENTS

| | | | |
|---|---|---|---|
| 2,753,865 | 7/1956 | Van Der Kogel | 128/201.11 |
| 3,860,042 | 1/1975 | Green | 128/201.11 |
| 3,908,647 | 9/1975 | Taunton | 128/201.11 |
| 4,061,140 | 12/1977 | Saito | 128/201.11 |
| 4,071,024 | 1/1978 | Blanc | 128/201.11 |
| 4,793,341 | 12/1988 | Arasmith | 128/201.11 |
| 4,872,453 | 10/1989 | Christianson | 128/201.11 |
| 5,143,059 | 9/1992 | Delphia | 128/201.11 |
| 5,199,422 | 4/1993 | Rasocha | 128/201.11 |
| 5,267,556 | 12/1993 | Feng | 128/201.11 |
| 5,404,872 | 4/1995 | Choi | 128/201.11 |

FOREIGN PATENT DOCUMENTS

| | | |
|---|---|---|
| 712617 | 9/1966 | Italy . |
| 312092 | 6/1969 | Sweden . |

*Primary Examiner*—Edgar S. Burr
*Assistant Examiner*—Eric P. Raciti
*Attorney, Agent, or Firm*—Greer, Burns & Crain, Ltd.

[57] ABSTRACT

An apparatus for use with a snorkel having a breathing tube with an upper end, the apparatus being constructed and arranged to prevent splash water from entering the snorkel tube, and including a tubular housing portion defining a Z-axis and a cylindrical interior volume, having a splash opening, defining a slot opposite the splash opening, and having an open bottom end for disposition upon the upper end of the snorkel tube, an arcuate channel defined by a hood portion of the housing and being in fluid communication with the cylindrical volume through the slot, the channel being disposed relative to the tubular portion to receive splash water entering the opening and eject it from the housing, and a substantially planar first baffle secured to the tubular portion and extending into the tubular volume at an incline to intercept splash water and direct it externally of the housing.

16 Claims, 3 Drawing Sheets

SNORKEL SPLASH PROTECTOR

FIELD OF THE INVENTION

The present invention relates generally to snorkels and, more particularly, to attachments designed for use with such snorkels for preventing splashed water from entering the snorkel breathing tube.

BACKGROUND OF THE INVENTION

Water from a wave or splash typically enters a conventional snorkel through the upper end of the breathing tube, and then passes into and through the breathing tube to the mouthpiece. Unwanted water can also enter the snorkel when the user submerges underwater during a dive. Upon surfacing, the diver must clear the snorkel by a blast of exhaled air, which forces the remaining water back out through the upper end of the snorkel.

Various devices are known in the art to prevent splash and wave water from entering the breathing tube of a snorkel. Many such prior devices employ shrouds, valves and/or flap structures to deflect water from entering the breathing tube and/or to eject undesirable accumulated water from the breathing tube. However, prior splash preventive devices, particularly those with valves, have failed to provide a low cost splash protector which is still effective.

One object of the present invention is to overcome the disadvantages in the prior art by providing an improved splash deflector structure devoid of moving parts and which is simply constructed.

Another object of the present invention is to provide an improved snorkel splash deflector having a fixed baffle and vent structure to more effectively prevent splash and wave water from entering the snorkel breathing tube.

Still another object of the present invention is to more effectively deflect water blown from the breathing tube back into the surrounding water.

SUMMARY OF THE INVENTION

The above-listed objects are met or exceeded by the present splash protector attachment, which is constructed and arranged for disposition on the upper open end of a snorkel breathing tube. The splash protector of the present invention works by preventing undesirable splash water from entering and accumulating in the breathing tube of the snorkel. In addition, the present splash protector also allows the user of the snorkel to expel accumulated water in the breathing tube through the splash protector so that the expelled or purged water does not reenter the breathing tube, and is instead diverted to ambient.

More specifically, the present snorkel splash protector apparatus is for use with a snorkel having a breathing tube with an upper end, the apparatus being constructed and arranged to prevent splash water from entering the snorkel tube. The protector includes a tubular housing portion defining a z-axis and a cylindrical interior volume, having a splash opening, defining a slot opposite the splash opening, and having an open bottom end for disposition upon the upper end of the snorkel tube.

An arcuate channel is defined by a hood portion of the housing and is in fluid communication with the cylindrical volume through the slot. The channel is disposed relative to the tubular portion to receive splash water entering the opening and eject it from the housing. Also included in the present splash protector is a substantially planar first or lower baffle secured to the tubular portion and extending into the tubular volume at an incline to intercept splash water and direct it externally of the housing.

Splash water enters the splash protector through a splash opening, and a portion of the water impinges the lower baffle and is directed to ambient. At least another portion of the water also passes through the slot and exits to ambient.

Water is expelled from the breathing tube by blowing the water through the splash protector device. The water impinges the lower baffle, deflecting the water into the elongate slot. That water passes through the slot into the arcuate channel and out of the splash protector. If the expelled water has sufficient velocity, the water deflected from the lower baffle will impinge the second or upper baffle deflecting the water through the splash opening and out of the splash protector.

Another aspect of the present invention is a combination of a snorkel and a splash protector for expelling water from the snorkel and to prevent splash water from entering the snorkel. The snorkel includes a breathing tube having upper and lower ends and a mouthpiece attached to the lower end. The upper end is attached to the splash protector described above. Preferably, the breathing tube further includes a purge valve below the mouthpiece.

DETAILED DESCRIPTION OF THE INVENTION

Figure 1:
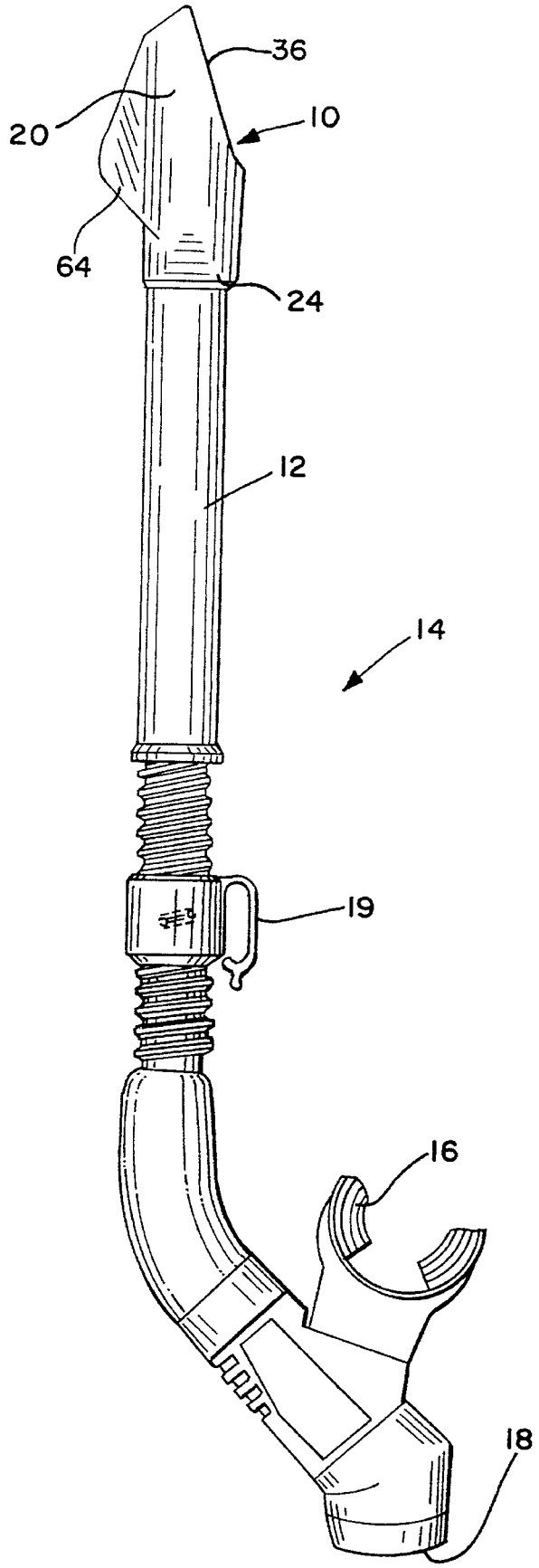
FIG. 1 is a front elevational view of a snorkel equipped with the splash protector attachment of the present invention.

Referring now to FIG. 1, the splash protector attachment of the present invention is generally designated 10 and is shown attached to the upper otherwise open end of a snorkel breathing tube 12 of a snorkel 14. A snorkel 14 of the type which is suitable for use with the present splash protector attachment 10 is described in greater detail in U.S. Pat. No. 4,834,084, which is incorporated herein by reference. However, it is contemplated that the attachment 10 may be used with a variety of conventional snorkels. The snorkel 14 also includes a mouthpiece 16 and, below the mouthpiece, a purge valve 18, which is preferably of the diaphragm type and well known in the art. A mask strap retaining clip 19 is preferably provided to secure the snorkel 14 to a diver's mask strap.

Figure 3:
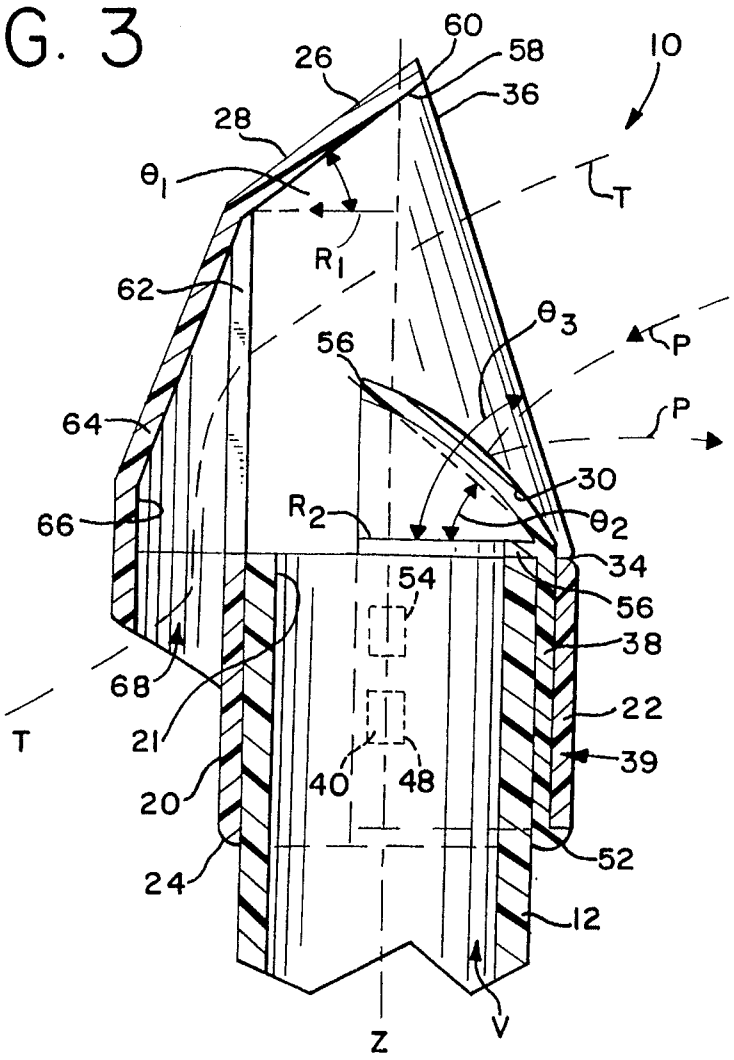
FIG. 3 is a sectional view taken along the line 3—3 of FIG. 2 and in the direction generally indicated.
Figure 2:
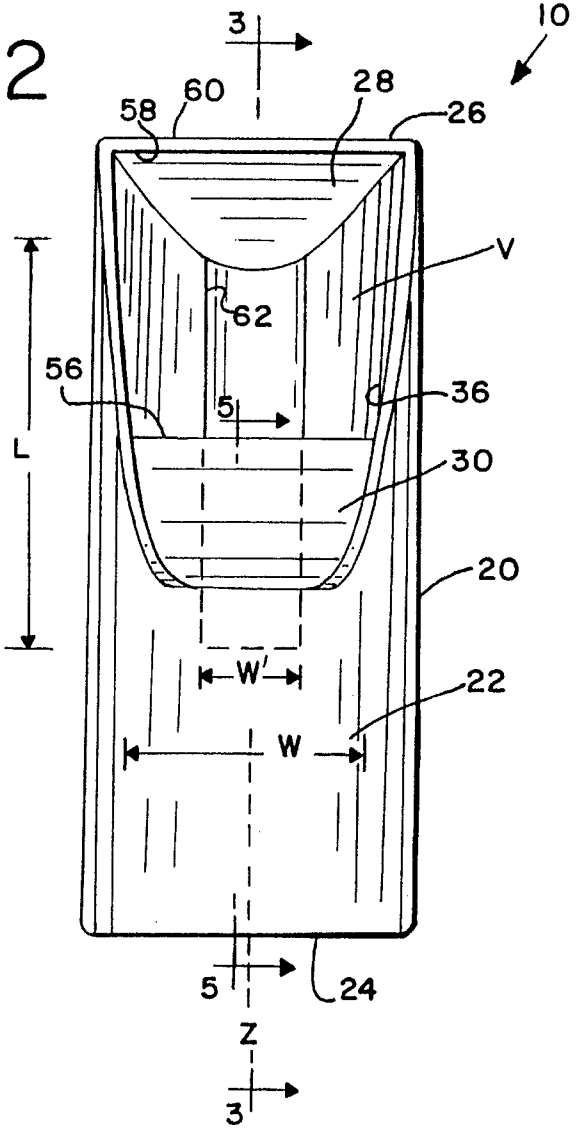
FIG. 2 is a front elevational view of the splash protector of the present invention.
Figure 4:
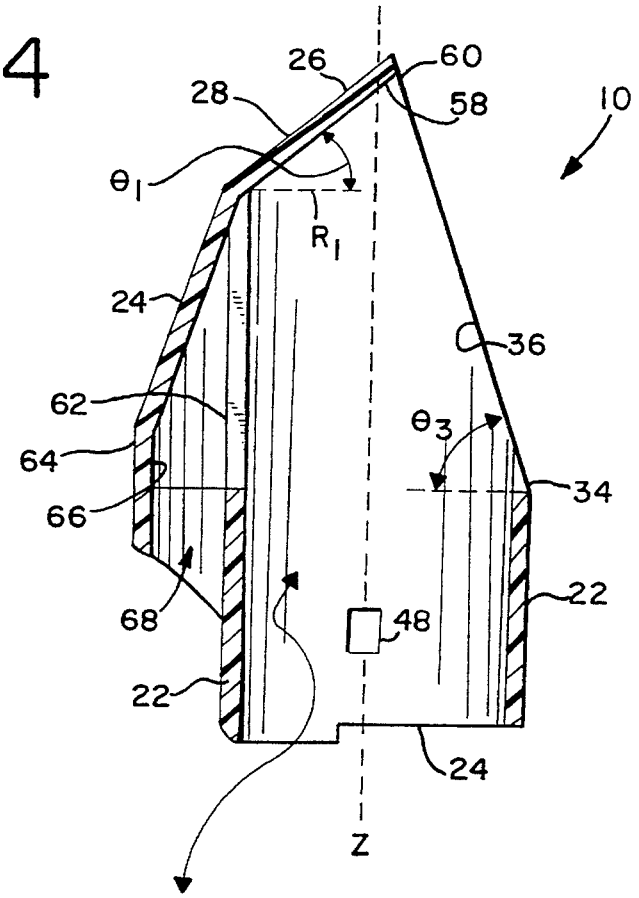
FIG. 4 is a fragmentary cross-sectional side view of the splash protector shown in FIG. 3.

Referring now to FIGS. 2–4, included in the attachment 10 is a housing 20 which has a generally tubular lower portion 22 defining an axis Z, as well as a tubular internal volume V. The housing 20 is preferably constructed from an injection moldable resin, such as a polycarbonate, however other moldable plastic materials are contemplated. A bottom end 24 of the housing 20 is open to matingly engage an upper end 21 of the snorkel tube 12 (best seen in FIG. 3).

Opposite the bottom end 24, an upper end 26 of the housing 20 is provided with an upper baffle 28 which is inclined at an angle $\theta^1$ relative to a radius R1 of the axis Z. A lower baffle 30 is disposed below the upper baffle 28 and projects at an incline into the volume V at an angle $\theta^2$ relative to a radius R2 of the axis Z. It is preferred that the respective angles of the upper and lower baffles 28, 30 are oblique relative to each other. The lower baffle 30 is secured within the housing 20 so that a lower edge 32 of the baffle is adjacent a lower edge 34 of a splash opening 36.

Figure 5:
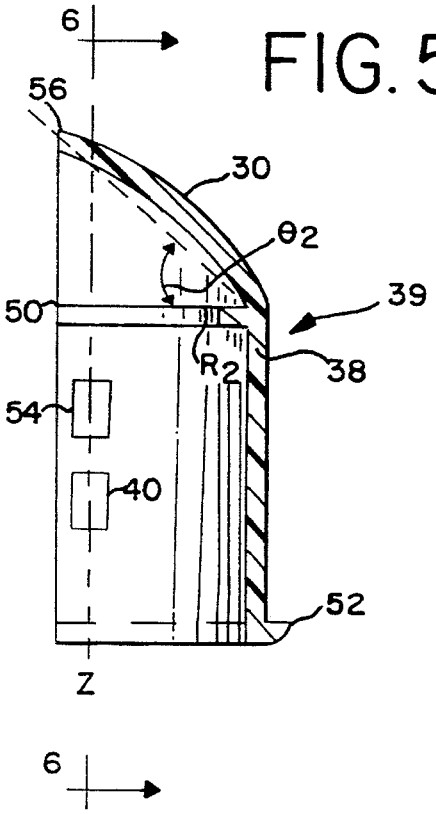
FIG. 5 is a sectional view taken along the line 5—5 of FIG. 2 and in the direction generally indicated.
Figure 6:
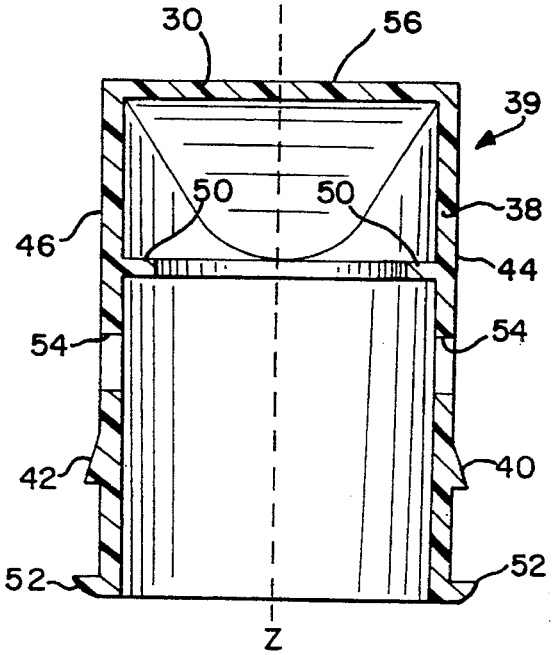
FIG. 6 is a sectional view taken along the line 6—6 of FIG. 5 and in the direction generally indicated.

Referring now to FIGS. 3, 5 and 6, in the preferred embodiment, the lower baffle 30 is molded as a separate part which is integrally formed with a semi-tubular base portion 38, with the combination being referred to as a baffle insert 39. The base portion 38 is constructed and arranged to have a tight friction fit against the inside of the tubular portion 22, and is secured in position by at least one and preferably two laterally projecting barbs 40, 42 located along the side edges 44, 46 of the base portion 38. Each barb 40, 42 is designed and positioned to engage a corresponding aperture 48 in the lower tubular portion 22. The apertures 48 are preferably located 180° apart from each other. An interior semi-annular ridge support 50 adds structural support to the base portion 38, and a peripheral lip 52 facilitates engagement of the base portion 38, with the tubular portion 22 by abutting the bottom end 24.

As an option, the base portion 38 may be provided with mounting apertures 54 located above the barbs 40, 42. These apertures are designed to engage corresponding barbs or other similar locking formations (not shown) on the snorkel breathing tube 12 for more securely retaining the attachment 10 upon the snorkel 14. As an alternative to the base portion 38, it is also contemplated that the lower baffle 30 may be integrally formed with the housing 20, such as through the use of chemical adhesives, ultrasonic welding or through molding.

Returning now to FIGS. 2, 3 and 4, the lower baffle 30 terminates at an upper edge 56 having a width W which is approximately ⅓ to ½ the way to the upper end 58 of the splash opening 36. The upper end 58 of the splash opening is also defined by an upper edge 60 of the upper baffle 28. Also projecting into the tubular volume V, the splash opening 36 defines an angle $\theta^3$ above the radius R2 of the axis z. Preferably, both $\theta^2$ and $\theta^3$ are in the range of 30° to 50°, with $\theta^2$ being smaller than $\theta^3$. The height and inclination of the lower baffle 30 are designed to intercept at least a portion of splashed water entering the splash opening 36 and diverting it to ambient along a hypothetical trajectory P (best seen in FIG. 3).

Opposite the splash opening 36 in the housing 20 is defined an elongate slot 62, which is preferably defined by upwardly extending members of the tubular portion 22. The elongate slot 62 has a longitudinal length L and a width W'. Preferably, the length L has an upper end defined by the upper baffle 26, and the width W of the lower baffle 30 is approximately twice the width W' of the elongate slot 62.

Also opposite the splash opening, and encircling the slot 62 is a hood portion 64 of the housing 20. The hood portion 64 is preferably integral with the housing, and defines an arcuate channel 66 which is in fluid communication with the cylindrical volume V through the slot 62. In addition, the hood portion 64 defines a lower opening 68 through which the channel 66 is in communication with ambient. The channel 66 is disposed relative to the slot 62 and the splash opening 36 to receive at least a portion of splash water entering the opening and eject it from the housing to ambient. A hypothetical trajectory of such splash water is designated T (best seen in FIG. 3).

To assemble the splash protector 10, the baffle insert 39 is inserted into the housing 20 through the lower end 24 until the barbs 40, 42 snap into the corresponding apertures 48. The assembled splash protector attachment 10 may then be attached to the upper end of a snorkel breathing tube 12 as seen in FIGS. 1 and 3.

In use, the snorkel 14, will be subject to splash water caused by wave action and splashes caused by the diver's swimming action. A feature of the present snorkel attachment 10 is that splash water will be prevented from entering the breathing tube in three major ways. First, the design of the attachment 10 restricts the entry of fluid into the breathing tube. Second, the lower baffle 30 intercepts at least a portion of splashed water and diverts it to ambient along the trajectory P. Third, another portion of the splash water is directed by the tubular housing 20 into the slot 62 and ultimately to ambient through the channel 66. The construction of the hood portion 64 prevents unwanted splash water from entering the breathing tube from this direction.

Water also accumulates in the breathing tube 12 when the user submerges. Upon surfacing, a majority of such water will be drained through the lower purge valve 18. However, any remaining water must be expelled by the diver with a blast of air out the top 21 of the breathing tube.

Another feature of the present snorkel attachment 10 is that such purged water will be prevented from reentering the breathing tube 12. At least a portion of the expelled water intercepts the underside of the lower baffle 30, and is diverted into the slot 62 and out the channel 66. Water which bypasses the lower baffle 30 will impact the upper baffle 28 and thus be deflected to ambient. While a particular embodiment of the splash protector snorkel attachment of the invention has been shown and described, it will be appreciated by those skilled in the art that changes and modifications may be made thereto without departing from the invention in its broader aspects and as set forth in the following claims.

What is claimed is:

1. An apparatus for use with a snorkel having a breathing tube with an upper end, the apparatus being constructed and arranged to prevent splash water from entering a snorkel breathing tube and to expel water from same, and comprising:

a generally tubular housing portion defining a Z-axis and a generally cylindrical interior volume, said generally tubular housing portion having a splash opening, and defining a slot opposite said splash opening, and having an open bottom end for disposition upon the upper end of a snorkel breathing tube;

said generally tubular housing portion further having a hood portion, said hood portion defining a generally arcuate channel, said channel being in fluid communication with said cylindrical volume through said slot, said channel being disposed relative to said tubular housing portion to receive splash water entering said splash opening and to eject it from said tubular housing portion; and a lower baffle secured to the tubular portion and extending into said interior volume at an incline to intercept splash water and direct it externally of said tubular housing portion.

2. The apparatus of claim 1 further including an upper baffle integral with said generally tubular housing portion, disposed above said lower baffle relative to said open bottom end of said generally tubular housing portion for preventing splash water from entering said generally tubular housing portion and for deflecting splash water into said slot.

3. The apparatus of claim 2 wherein said upper baffle is oriented at an angle which is oblique to the angle of incline of said lower baffle.

4. The apparatus of claim 2 wherein said upper baffle is disposed at an angle $\theta^1$ relative to a radius of the Z-axis, which is in the range of 30° to 50°.

5. The apparatus of claim 1 wherein said lower baffle is disposed at an angle of incline $\theta^2$ which is in the range of 30° to 50°.

6. The apparatus of claim 1 further including means for releasably securing said lower baffle to said generally tubular housing portion.

7. The apparatus of claim 6 wherein the means for releasably securing includes a combination of at least one barb located on said lower baffle and at least one aperture located on said generally tubular housing portion.

8. The apparatus of claim 1 wherein said slot is narrower than a width of said lower baffle.

9. The apparatus of claim 8 wherein the width of said lower baffle is approximately twice the width of said slot.

10. The apparatus of claim 1 wherein said slot extends to a height that abuts said upper baffle.

11. The apparatus of claim 10 wherein the length of said slot extends above and below an upper edge of said lower baffle relative to said open bottom end.

12. A combination of a snorkel having a breathing tube and a splash protector that prevents splash water from entering the breathing tube, comprising:

a snorkel having a breathing tube having upper and lower ends, a mouthpiece attached to said lower end;

a splash protector including a generally tubular housing portion defining a Z-axis and a generally cylindrical interior volume, said housing portion having a splash opening, defining a slot opposite said splash opening, and having an open bottom end for disposition upon said upper end of said breathing tube;

said housing having a hood portion, said hood portion defining a generally arcuate channel, said channel being in fluid communication with said cylindrical volume through said slot, said channel being disposed relative to said tubular housing portion to receive splash water entering said splash opening and eject it from said tubular housing portion;

a lower baffle secured to said tubular housing and extending into said tubular volume at an recline to intercept splash water and direct it externally of said tubular housing.

13. The combination of claim 12 further including an upper baffle integral with the housing, disposed above said lower baffle relative to said bottom end of said splash protector for preventing splash water from entering said housing portion and for deflecting splash water into said slot.

14. The combination of claim 12 wherein said slot is narrower than a width of said lower baffle.

15. The combination of claim 12 wherein said slot extends to a height that abuts said upper baffle.

16. The combination of claim 12 further including a purge valve attached to the lower end of said snorkel below said mouthpiece.

* * * * *